US008449091B2

(12) United States Patent
Kanbe et al.

(10) Patent No.: US 8,449,091 B2
(45) Date of Patent: May 28, 2013

(54) INK CARTRIDGES

(75) Inventors: Tomohiro Kanbe, Nagoya (JP); Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 386 days.

(21) Appl. No.: 12/883,011

(22) Filed: Sep. 15, 2010

(65) Prior Publication Data

US 2011/0310188 A1 Dec. 22, 2011

(30) Foreign Application Priority Data

Jun. 17, 2010 (EP) ..... 10 166 402

(51) Int. Cl.
*B41J 2/175* (2006.01)

(52) U.S. Cl.
USPC ..... 347/86

(58) Field of Classification Search
USPC ..... 347/49, 85, 86, 87
See application file for complete search history.

(56) References Cited

U.S. PATENT DOCUMENTS

| | | | | |
|---|---|---|---|---|
| 5,604,523 | A * | 2/1997 | Tsukuda et al. | 347/86 |
| 6,030,075 | A | 2/2000 | Swanson et al. | |
| 6,270,207 | B1 * | 8/2001 | Sasaki | 347/86 |
| 6,955,422 | B2 * | 10/2005 | Miyazawa et al. | 347/86 |
| 7,527,344 | B2 * | 5/2009 | Kitagawa et al. | 347/7 |
| 7,618,137 | B2 * | 11/2009 | Inoue | 347/86 |
| 7,695,107 | B2 * | 4/2010 | Shimizu | 347/49 |
| 2007/0070152 | A1 | 3/2007 | Hattori et al. | |
| 2007/0242117 | A1 | 10/2007 | Ishizawa et al. | |
| 2008/0180496 | A1 | 7/2008 | Hattori et al. | |
| 2008/0239036 | A1 | 10/2008 | Hattori | |

FOREIGN PATENT DOCUMENTS

| | | | |
|---|---|---|---|
| EP | 1122073 | A2 | 8/2001 |
| EP | 1772270 | A2 | 4/2007 |
| EP | 1 790 480 | B1 | 5/2007 |
| EP | 1790480 | A1 | 5/2007 |
| EP | 1839871 | A1 | 10/2007 |
| EP | 1839873 | A1 | 10/2007 |
| EP | 2 039 521 | B1 | 3/2009 |
| EP | 2039520 | A1 | 3/2009 |
| JP | H10-086408 | A | 4/1998 |

(Continued)

OTHER PUBLICATIONS

European Patent Office, European Search Report for European Patent Application No. 10166402.7 (counterpart to above-captioned patent application), dated Oct. 1, 2010.

(Continued)

*Primary Examiner* — Anh T. N. Vo
(74) *Attorney, Agent, or Firm* — Baker Botts L.L.P.

(57) ABSTRACT

An ink cartridge is removably mounted to a recording apparatus. The ink cartridge includes a main body and first and second protrusions. A particular end of the second protrusion extends further than a particular end of the first protrusion in the insertion direction. The main body includes an ink chamber, a particular wall having a first end and a second end opposite the first end in a further direction, a communication portion that selectively places an interior of the ink chamber and an exterior of the ink chamber into fluid communication, a holding portion positioned opposite the particular wall, and a bottom wall. A distance from a rear end of the bottom wall to the particular end of the second protrusion in the insertion direction is less than a distance from a rear end of the holding portion to an end of the second protrusion in the insertion direction.

12 Claims, 13 Drawing Sheets

FOREIGN PATENT DOCUMENTS

| | | | |
|---|---|---|---|
| JP | 2007-196651 | A | 8/2007 |
| JP | 2007-283517 | A | 11/2007 |
| JP | 2008-044254 | A | 2/2008 |
| JP | 2008-200883 | A | 9/2008 |
| JP | 2008-238643 | A | 10/2008 |
| JP | 2009-132098 | A | 6/2009 |

OTHER PUBLICATIONS

European Patent Office, European Search Report for European Patent Application No. 10166374.8 (counterpart to co-pending U.S. Appl. No. 12/880,770), dated Oct. 1, 2010.

* cited by examiner

INK CARTRIDGES

CROSS REFERENCE TO RELATED APPLICATION

The present application claims priority to and the benefit of European Patent Application No. 10 166 402.7, which was filed on Jun. 17, 2010, the disclosure of which is incorporated herein by reference in its entirety.

BACKGROUND OF THE INVENTION

1. Field of the Invention

The present invention relates to ink cartridges configured to be mounted to a recording apparatus comprising an urging member configured to urge the ink cartridge in one direction.

2. Description of Related Art

A known tube-supply-type inkjet recording apparatus, such as an inkjet recording apparatus, as described in Patent No. EP 2 039 521 B1, has a recording head mounted on a carriage, and an ink cartridge positioned outside of the carriage and in fluid communication with the recording head via a tube. The inkjet recording apparatus has a cartridge mounting portion having an opening at a front face of a housing of the inkjet recording apparatus. The ink cartridge is configured to be inserted horizontally into the cartridge mounting portion via the opening to be mounted removably to the cartridge mounting portion. When the ink cartridge is mounted to the cartridge mounting portion, an ink path is formed from the ink cartridge to the recording head so that ink may flow therethrough. Thus, ink is supplied from the ink cartridge to the recording head via the ink path.

The ink cartridge has a main body, a cover configured to cover a portion of the main body, and a coil spring positioned between the main body and the cover. When the ink cartridge is mounted to the cartridge mounting portion, the main body is urged toward the opening of the cartridge mounting portion by the coil spring. The cartridge mounting portion has a lock arm, and the lock arm is configured to retain the main body in the cartridge mounting portion against an urging force of the coil spring.

When the lock arm is rotated, such that the ink cartridge is released, the ink cartridge is moved toward the opening by the coil spring, and stops moving in a stop position, in which a rear portion of the ink cartridge is positioned outside of the cartridge mounting portion. A user can hold and pull the rear portion of the ink cartridge to remove the cartridge. Ease of removal of the ink cartridge increases as the stop position is moved further outside by increasing the spring constant of the coil spring. Nevertheless, increasing the spring constant increases the urging force applied to the main body or to the lock arm, which may damage the cartridge mounting portion or the ink cartridge.

Another known ink cartridge, such as an ink cartridge described in Patent No. EP 1 790 480 B1, is configured to be mounted to a cartridge mounting portion and the cartridge mounting portion includes a door that opens and closes. When the door is opened by a user, the door latches to the ink cartridge to pull the ink cartridge from the cartridge mounting portion to the outside of the cartridge mounting portion. Nevertheless, the distance the ink cartridge is pulled by the door may be limited to a short distance, and thus it may be limited in easing the removal of the ink cartridge.

SUMMARY OF THE INVENTION

Therefore, a need has arisen for ink cartridges which overcome these and other shortcomings of the related art. A technical advantage of the present invention is that an ink cartridge readily may be removed from a recording apparatus.

An ink cartridge is configured to be removably mounted to a recording apparatus comprising an urging member configured to urge the ink cartridge in a removal direction. The ink cartridge comprises a main body. The main body comprises an ink chamber formed in an interior of the main body and configured to store ink therein, a particular wall having a first end and a second end opposite the first end in a further direction, wherein the further direction is perpendicular to the removal direction, a communication portion positioned at the particular wall and configured to selectively place an interior of the ink chamber and an exterior of the ink chamber into fluid communication, a holding portion positioned opposite the particular wall in an insertion direction, wherein the ink chamber is positioned between the particular wall and the holding portion, and the insertion direction is parallel to and opposite the removal direction, and a bottom wall. The ink cartridge also comprises a first protrusion extending from the main body in the insertion direction and away from the holding portion, and a second protrusion positioned adjacent to the bottom wall and extending from the main body in the insertion direction and away from the holding portion, wherein a particular end of the second protrusion extends further than a particular end of the first protrusion in the insertion direction, and wherein a distance from a rear end of the bottom wall to the particular end of the second protrusion in the insertion direction is less than a distance from a rear end of the holding portion to an end of the second protrusion along the insertion direction.

With this configuration, the ink cartridge readily may be removed from the recording apparatus, especially with the aid of the holding portion and the comparatively long second protrusion, which can be urged by the urging member in the direction of removal and moved by a relatively large distance.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawing.

DETAILED DESCRIPTION OF EMBODIMENTS OF THE INVENTION

Embodiments of the present invention, and their features and advantages, may be understood by referring to FIGS. 1-13, like numerals being used for like corresponding parts in the various drawings.

Figure 1:
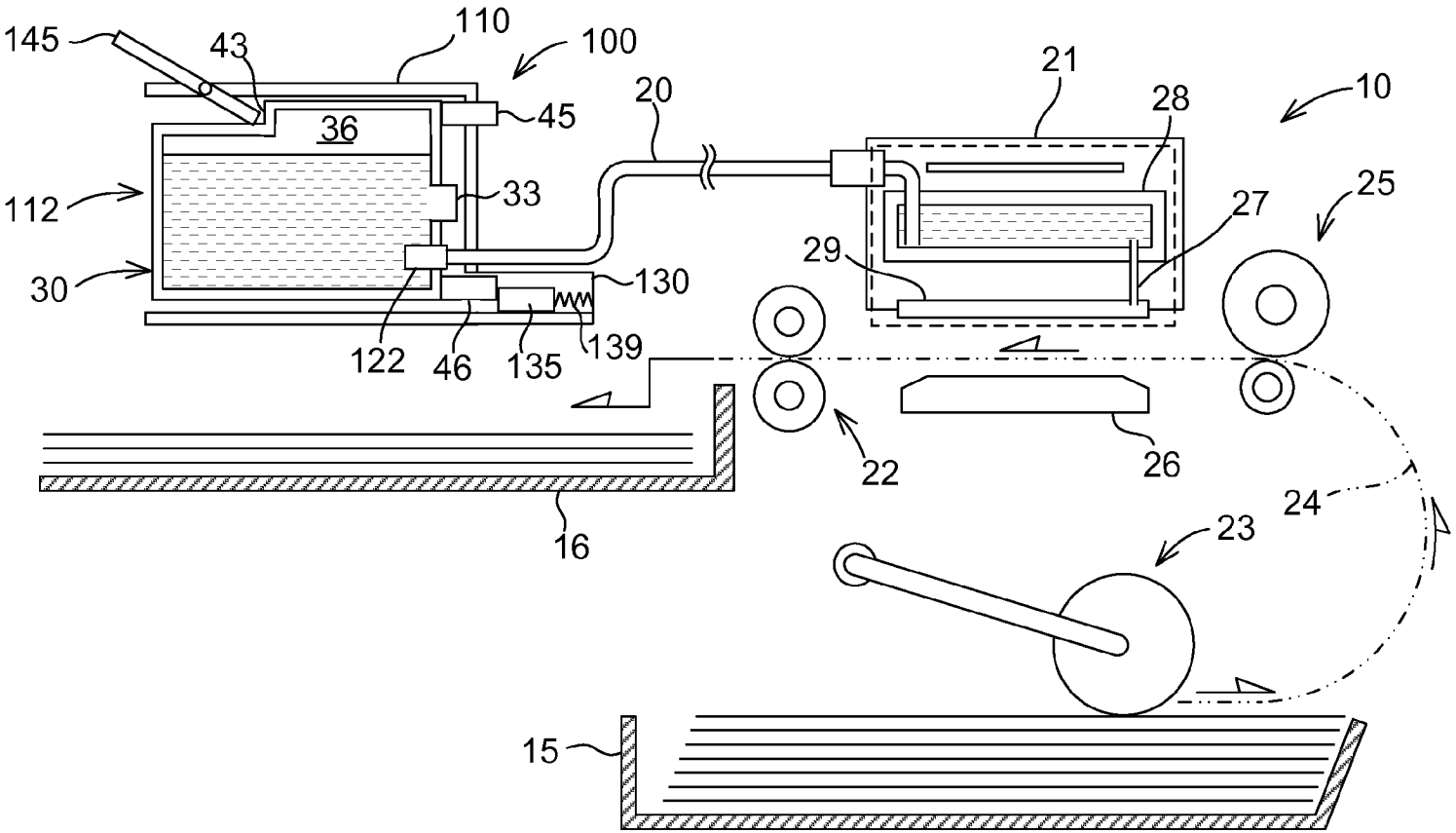
FIG. 1 is a schematic side cross-sectional view of a printer comprising an ink supply device, according to an embodiment of the invention.

Referring to FIG. 1, a recording apparatus, e.g., printer 10, may be configured to record an image by selectively ejecting ink droplets onto a recording sheet. Printer 10 may comprise a recording head 21 and an ink supply device 100 configured to supply ink to recording head 21. Ink supply device 100 may comprise a cartridge mounting portion 110. Cartridge mounting portion 110 may be configured, such that a first cartridge 30 and a second cartridge 60 are selectively and removably mounted to cartridge mounting portion 110. First cartridge 30 may have a greater capacity than second cartridge 60, e.g., the initial amount of ink stored in first cartridge 30 may be greater than the initial amount of ink stored in second cartridge 60. FIG. 1 shows first cartridge 30 as it is mounted to cartridge mounting portion 110. Cartridge mounting portion 110 may have an opening 112 formed therethrough. First and second cartridges 30, 60 may be inserted into or removed from cartridge mounting portion 110, e.g., through opening 112. Ink supply device 100 may comprise a plurality of cartridge mounting portions 110, such that cartridges 30, 60 may be mounted to adjacent cartridge mounting portions 110, e.g., in a side by side position.

First and second cartridges 30, 60 may be configured to store ink for use in a printer, e.g., printer 10. When first cartridge 30 or second cartridge 60 is mounted to cartridge mounting portion 110, the mounted first cartridge 30 or second cartridge 60 may be in fluid communication with recording head 21 via a flexible tube 20, which may be connected to cartridge mounting portion 110 at one end and to recording head 21 at the other end. A sub-tank 28 may be positioned within recording head 21. Sub-tank 28 may be configured to temporarily store ink supplied from cartridge 30 or 60 via flexible tube 20 and to supply ink to nozzles 29 of recording head 21. Recording head 21 may be configured to eject ink selectively from nozzles 29.

A pick-up roller 23 may pick up recording sheets from a sheet tray 15 one by one, and the picked-up recording sheet may be conveyed to a conveying path 24. The recording sheet may be conveyed by a conveying means, e.g., conveying rollers 25, onto a platen 26. Recording head 21 selectively may eject ink onto the recording sheet, conveyed onto platen 26 by conveying rollers 25, to record an image on the recording sheet. After the recording sheet is conveyed past platen 26, output rollers 22 may output the recording sheet to an output tray 16, which may be positioned on the most downstream side of conveying path 24 in a sheet conveying direction.

Figure 2:
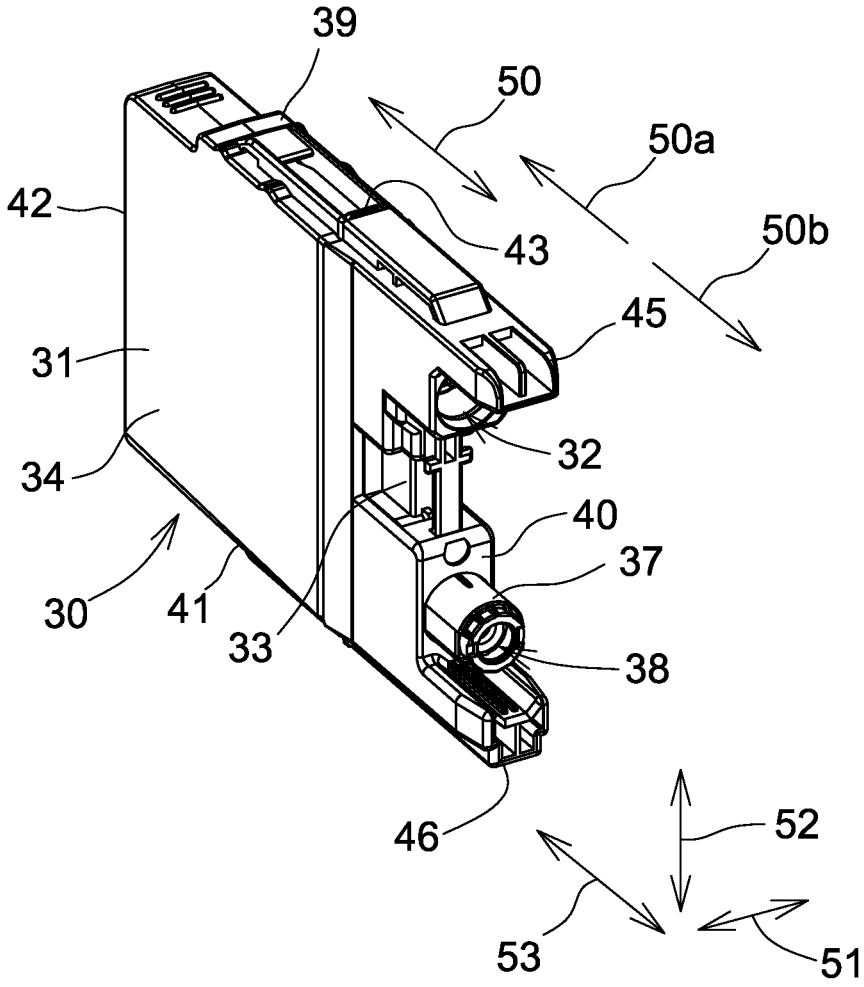
FIG. 2 is a perspective view of a first cartridge, according to an embodiment of the invention.
Figure 3:
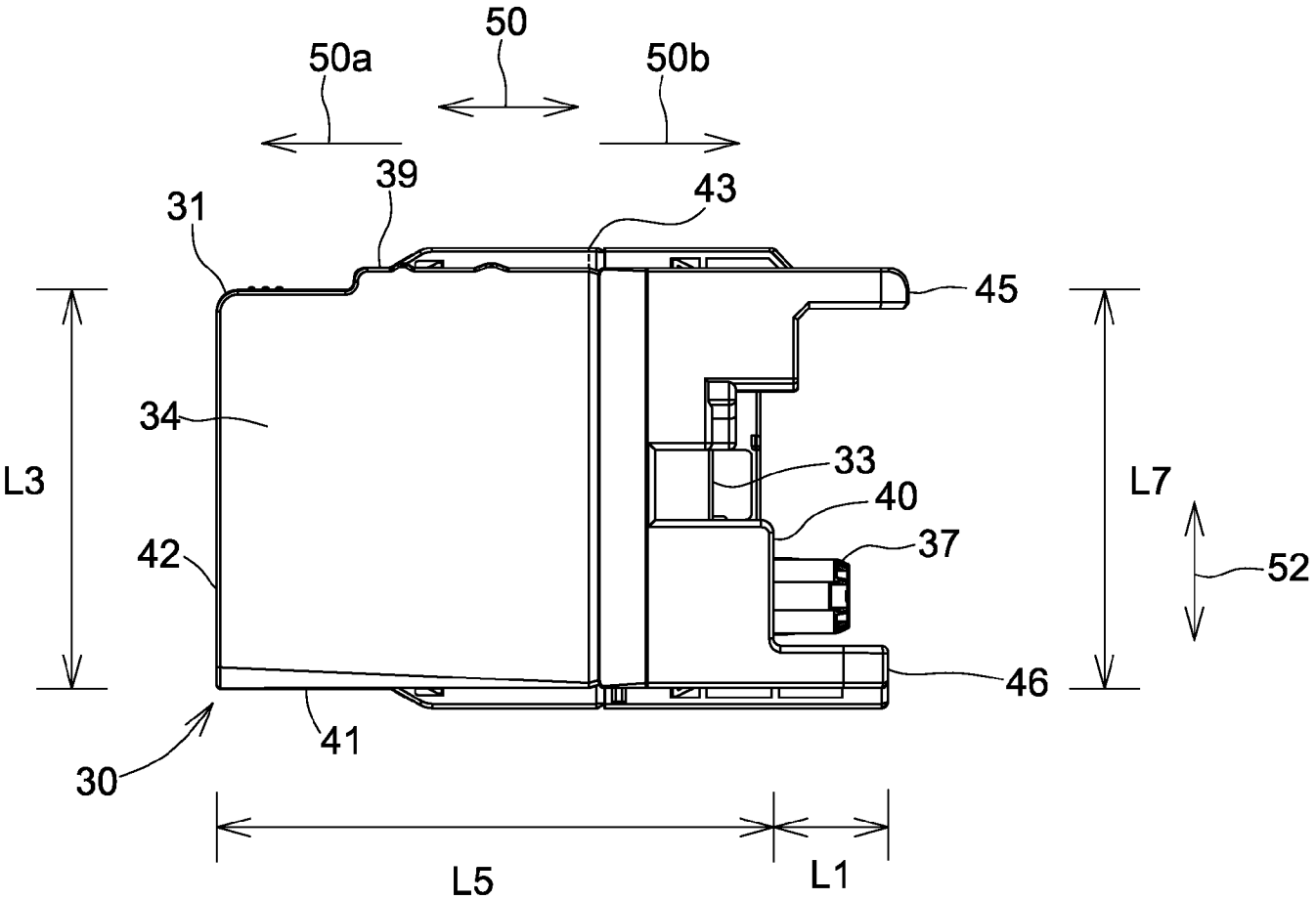
FIG. 3 is a side view of the first cartridge of FIG. 2.
Figure 4:
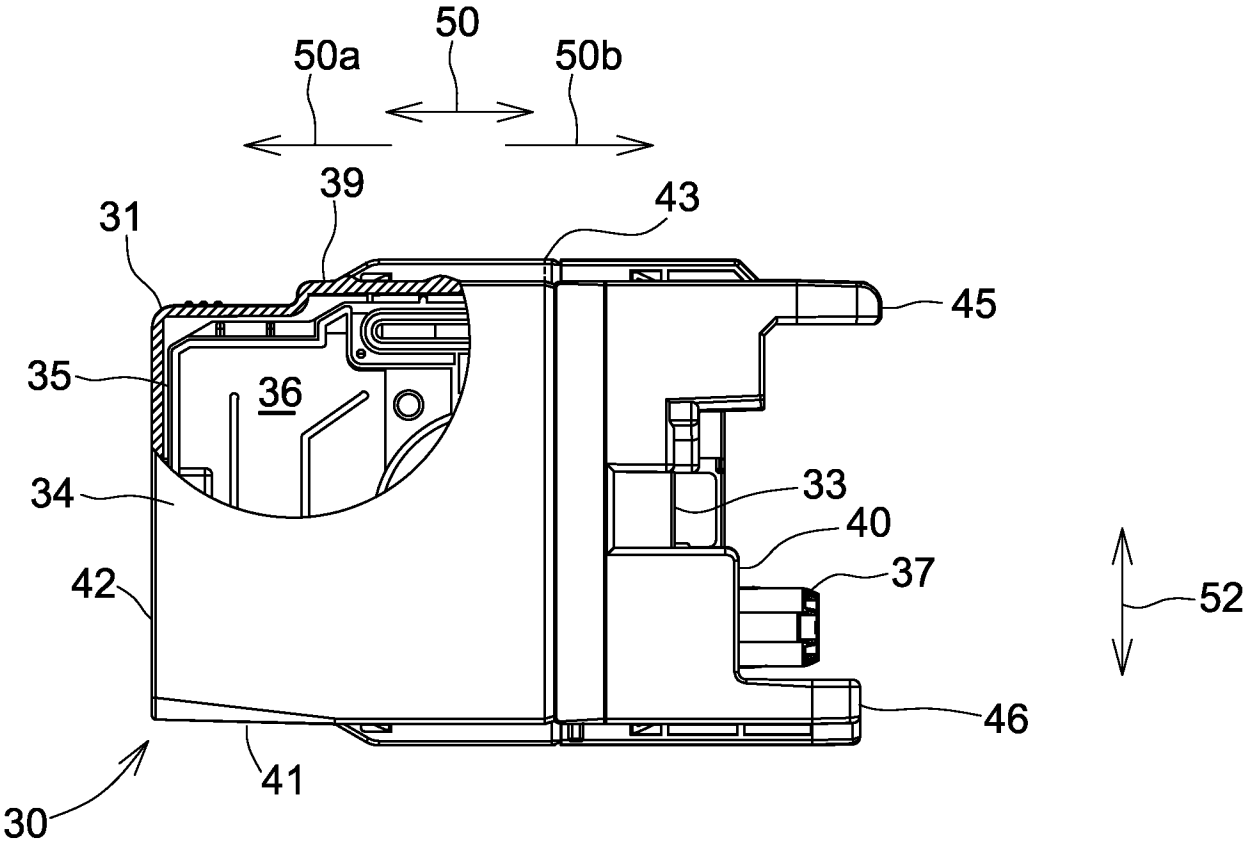
FIG. 4 is a partially cutaway side view of the first cartridge of FIG. 3.

Referring to FIGS. 2-4, first cartridge 30 may be a container configured to store ink therein. First cartridge 30 selectively may be inserted into and disengaged from cartridge mounting portion 110 along an insertion/removal path 50, respectively. More specifically, first cartridge 30 may be inserted into cartridge mounting portion 110 in an insertion direction **50*b* and may be removed, e.g., disengaged, from cartridge mounting portion 110 in a removal direction 50*a* opposite to insertion direction 50*b*. Each of insertion/removal path 50, insertion direction 50*b* and removal direction 50*a*** may be parallel to a horizontal direction.

First cartridge 30 may comprise a main body 31 having a substantially rectangular parallelepiped shape. Main body 31 may have a flat, box shape having a width in a width direction 51, a height in a height direction 52, and a depth in a depth direction 53, in which the width is less than each of the height and the depth. Width direction 51, height direction 52, and depth direction 53 may be substantially perpendicular to each other, and each of width direction 51, height direction 52, and depth direction 53 may be orthogonal to a plane formed by the other two directions. When first cartridge 30 selectively is inserted into and removed from cartridge mounting portion 110, insertion/removal path 50 may be perpendicular to height direction 52 and parallel to depth direction 53.

Main body 31 of first cartridge 30 may comprise a front wall 40 and a rear wall 42. Rear wall 42 may be positioned opposite to front wall 40 in insertion/removal path 50. When first cartridge 30 is inserted into cartridge mounting portion 110, front wall 40 may face insertion direction **50*b*, and rear wall 42 may face removal direction 50*a*. Main body 31 of first cartridge 30 may comprise a top wall 39 and a bottom wall 41 opposite top wall 39 in height direction 52. Top wall 39 may be connected to an upper end of front wall 40 at one end and connected to an upper end of rear wall 42 at the other end. Bottom wall 41 is connected to a lower end of front wall 40 at one end and connected to a lower end of rear wall 42 at the other end. First cartridge 30 selectively may be inserted into and removed from cartridge mounting portion 110 along insertion/removal path 50, in an orientation as shown in FIG. 2, e.g., top wall 39 thereof facing upward and bottom wall 41** thereof facing downward.

Main body 31 may comprise an internal container 35 and a cover member 34 configured to cover internal container 35. Internal container 35 may comprise an ink chamber 36 formed therein. Cover member 34 may comprise front wall 40, rear wall 42, top wall 39, and bottom wall 41. Ink chamber 36 formed in an interior of internal container 35 may extend over an area adjacent to front wall 40 and rear wall 42.

A residual amount detection portion 33 may be positioned at a middle portion of front wall 40 of main body 31 in height direction 52. Residual amount detection portion 33 may have an open-box shape with an open end. Residual amount detection portion 33 may be in fluid communication with ink chamber 36, via the open end. Residual amount detection portion 33 may comprise a pair of walls comprising translucent, e.g., transparent or semi-transparent, resin configured to allow light, e.g., infrared or visible light, emitted from an optical sensor 114 to pass therethrough. Optical sensor 114 may be positioned at cartridge mounting portion 110. When first cartridge 30 is mounted to cartridge mounting portion 110, residual amount detection portion 33 may allow the light emitted from optical sensor 114 to pass therethrough, or may block or attenuate the light, depending on the amount of ink stored in ink chamber 36. An amount of the light that passes through residual amount detection portion 33, may be used to determine whether the residual ink amount in ink chamber 36 is less than a predetermined amount. Residual amount detection portion 33 may comprise a detection device, such as a light blocking plate positioned in residual amount detection portion 33 and configured to move based on the amount of ink stored in ink chamber 36. Residual amount detection portion 33 may comprise a prism that diverts or bends the light in different directions based on the amount of ink stored in ink chamber 36. The pair of walls irradiated with the light emitted from optical sensor 114 may be vertical, e.g., extending in height direction 52, or may be inclined with respect to a vertical direction, e.g., inclined with respect to height direction 52.

An air communication opening 32 may be positioned at front wall 40 above residual amount detection portion 33 in height direction 52. In particular, air communication opening 32 may be formed through front wall 40 in depth direction 53. Ink chamber 36 and the atmosphere outside first cartridge 30 may be placed into communication with each other via air communication opening 32. Air communication opening 32 may be configured to be opened or closed selectively by a valve (not shown). When air communication opening 32 is opened, pressure in ink chamber 36 may equalize to atmospheric pressure. In another embodiment, air communication opening 32 may be positioned at a different location within main body 31 and may be configured to bring the interior of ink chamber 36 into fluid communication with the exterior of ink chamber 36, e.g., the atmosphere. Further, in still another embodiment, if the interior of ink chamber 36 is maintained at negative pressure, air communication opening 32 may be omitted.

A communication portion, e.g., an ink supply portion 37, may be positioned at front wall 40 below residual amount detection portion 33 in height direction 52. Ink supply portion 37 may have a cylindrical outer shape. Ink supply portion 37 may extend outward from front wall 40 and perpendicular to front wall 40, e.g., in an insertion direction 50*b*. An ink flow path 38 may be formed in a middle portion of ink supply portion 37 to extend along insertion/removal path 50. As shown in FIG. 1, ink stored in ink chamber 36 may flow into an ink supply tube 122 of cartridge mounting portion via ink flow path 38.

A rear portion of top wall 39 of main body 31 in insertion direction 50*b* may be lower, in height direction 52, than a front portion of top wall 39. The rear portion of top wall 39 may be positioned closer to rear wall 42 than to front wall 40, and the front portion of top wall 39 may be positioned closer to front wall 40 than to rear wall 42. A vertical wall 43 may be formed substantially at a middle portion of top wall 39 along insertion/removal path 50. Vertical wall 43 may comprise a plane extending in width direction 51 and height direction 52 of first cartridge 30. As shown in FIGS. 1 and 8-13, a lock lever 145 of cartridge mounting portion 110 may be configured to engage vertical wall 43 when first cartridge 30 is mounted to cartridge mounting portion 110. Vertical wall 43 may be configured to receive an urging force that urges first cartridge 30 out of cartridge mounting portion 110 in removal direction 50*a*.

First cartridge 30 may comprise a first protrusion 45 and a second protrusion 46. First protrusion 45 may be disposed at the upper end of front wall 40 of main body 31. The width of first protrusion 45 may be equal to the width of front wall 40 in width direction 51. First protrusion 45 may be connected to or formed on front wall 40 and may extend outward from front wall 40. For example, first protrusion 45 may extend in insertion direction 50*b* from front wall 40. In another embodiment, first protrusion 45 may have a plate shape having a width which is less than the width of front wall 40 in width direction 51.

Second protrusion 46 may be disposed at the lower end of front wall 40 of main body 31 below ink supply portion 37 in height direction 52. The width of second protrusion 46 may be equal to the width of front wall 40. Second protrusion 46 may be connected to or formed on front wall 40 and may extend outward from front wall 40. Second protrusion 46 may extend in insertion direction 50*b* from front wall 40. Second protrusion 46 may extend further than ink supply portion 37 in insertion direction 50*b*, e.g., an end of second protrusion 46 may be disposed further from ink chamber 36 than an end of ink supply portion 37 is disposed from ink chamber 36. In another embodiment, second protrusion 46 may have a plate shape and may have a width which is less than the width of front wall 40. Referring to FIG. 3, second protrusion 46 may extend from front wall 40 in insertion direction 50*b* by a length L1. Length L1 may be based on an ink capacity of first cartridge 30. The length of the second protrusion may vary from one ink cartridge to another based on the ink capacity of the ink cartridge. For example, a cartridge having a different ink capacity than the ink capacity of first cartridge 30 may comprise a second protrusion having a different length than length L1. Length L1 may have relationship with the initial amount of ink stored in ink chamber 36. The length of the second protrusion may vary from one ink cartridge to another based on the initial amount of ink stored in each ink chambers. For example, a cartridge storing a different initial amount of ink than the initial amount of ink stored in first cartridge 30 may comprise a second protrusion having a different length than length L1.

Length L1 of second protrusion 46 may be based on an outer shape of a rear portion of main body 31. For example, length L1 of second protrusion 46 may be based on an outer shape of rear wall 42 and a portion of main body 31 adjacent to rear wall 42. The length of the second protrusion may vary from one ink cartridge to another based on the outer shape of the rear portion of a main body in each ink cartridges. For example, a cartridge comprising a main body whose rear portion has a different outer shape than the outer shape of the rear portion of main body 31 may comprise a second protrusion having a different length than length L1. As shown in FIG. 3, main body 31 of first cartridge 30 may have a rectangular shape in side view. Rear wall 42 may have a length L3 in height direction 52. Length L3 may be based on an initial amount of ink stored in ink chamber 36. The length of the rear wall may vary from one ink cartridge to another based on the initial amount of ink stored in an ink chamber of each ink cartridges. For example, a cartridge storing a different initial amount of ink than the initial amount of ink stored in first cartridge 30 may comprise a rear wall having a different length than length L3.

Main body 31 may have a length L5 between front wall 40 and rear wall 42 along insertion/removal path 50. Length L5 may be independent of the cartridge capacity and may not vary from one ink cartridge to another based on length L1 of second protrusion 46. For example, a cartridge comprising a second protrusion having a different length than length L1 may have the same length L5 between a front wall and a rear wall of a main body. Moreover, a height of front wall 40, e.g., a length L7 between top wall 39 and bottom wall 41 of main body 31, may be substantially equal to length L3.

In another embodiment, cover member 34 and internal container 35 of main body 31 may be an integrally-formed or integrally-molded component. In another embodiment, a main body 31 may comprise light-blocking resin. Main body 31 may be formed in a box-shape with an open end facing in insertion direction 50*b*. Ink chamber 36 may be disposed in an interior of main body 31. Cover 34 may comprise a translucent, e.g., transparent or semi-transparent, resin and may be attached to the open end of main body 31. Cover 34 may comprise a front wall and a residual amount detection portion and an ink supply portion integrally formed at the front wall. A first protrusion and a second protrusion also may be connected to or formed on the front wall.

Figure 5:
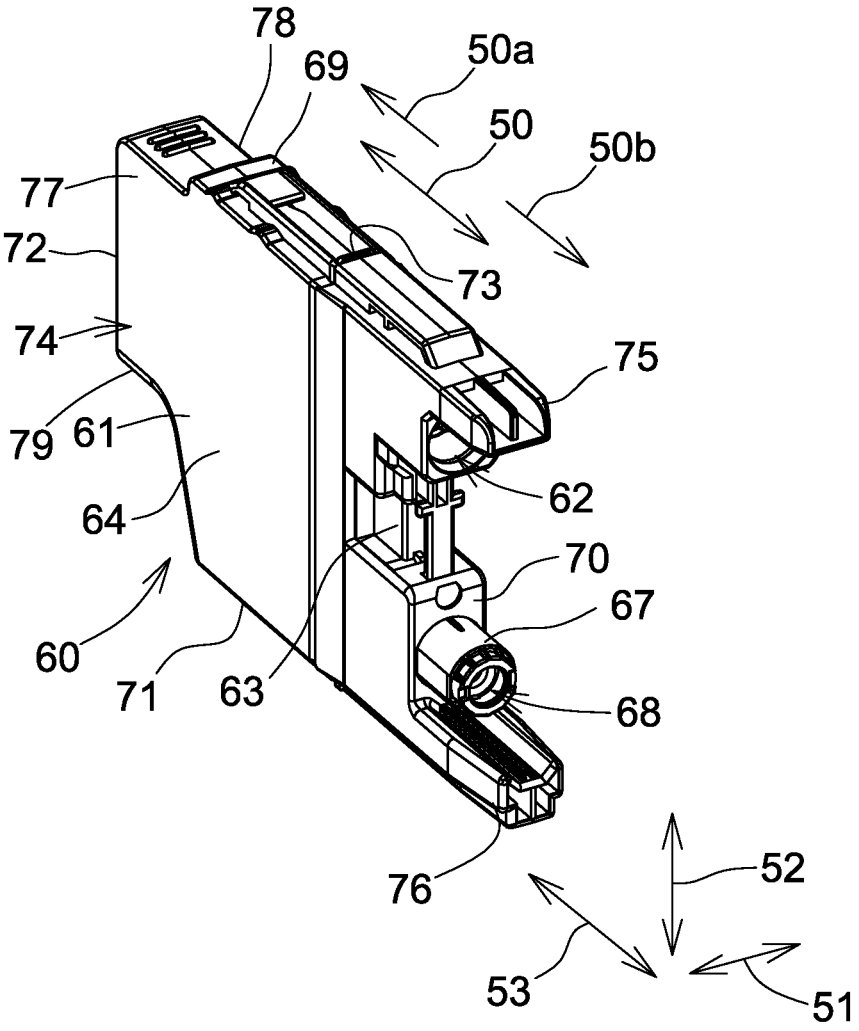
FIG. 5 is a perspective view of a second cartridge, according to an embodiment of the invention.
Figure 6:
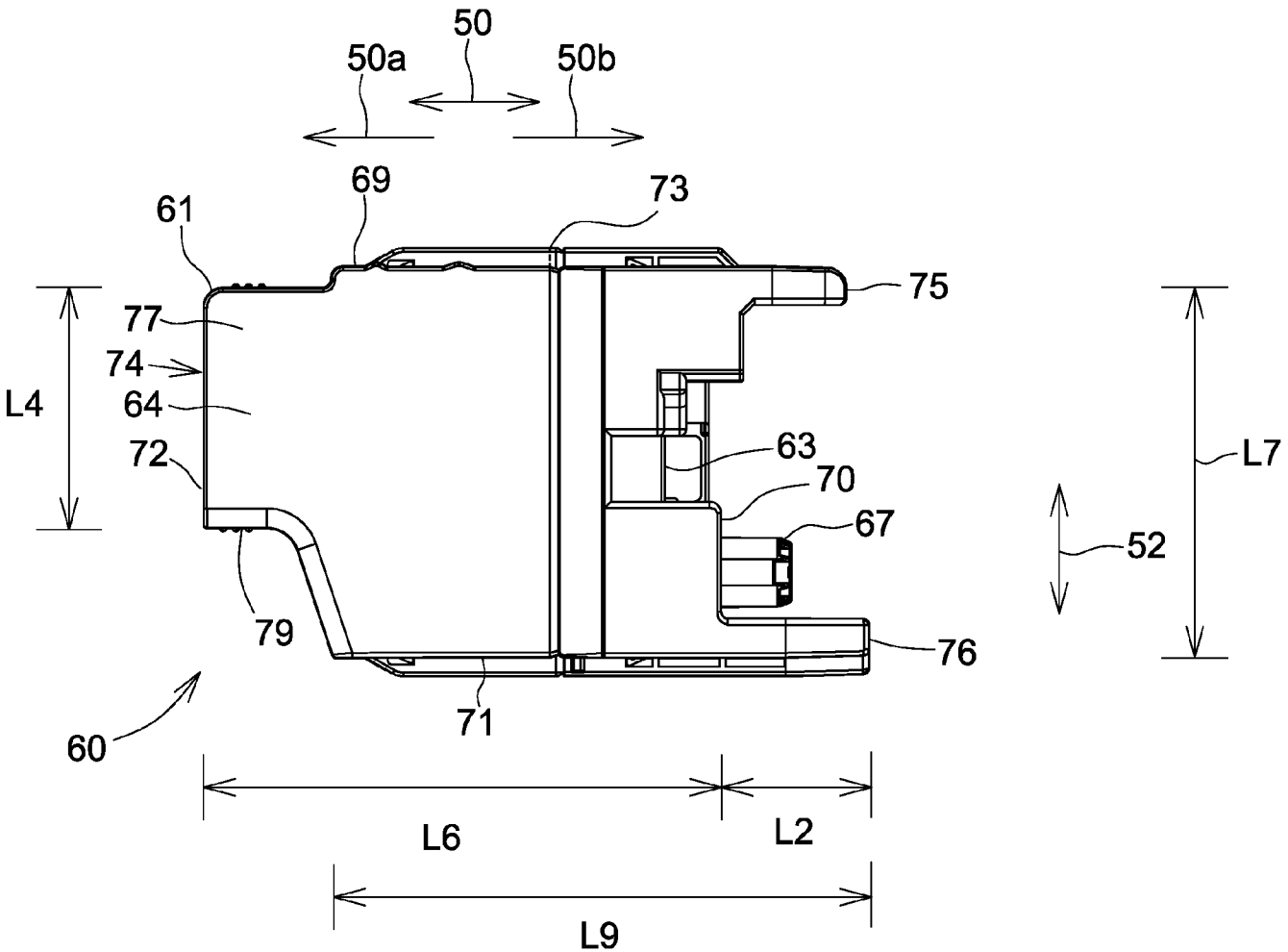
FIG. 6 is a side view of the second cartridge of FIG. 5.
Figure 7:
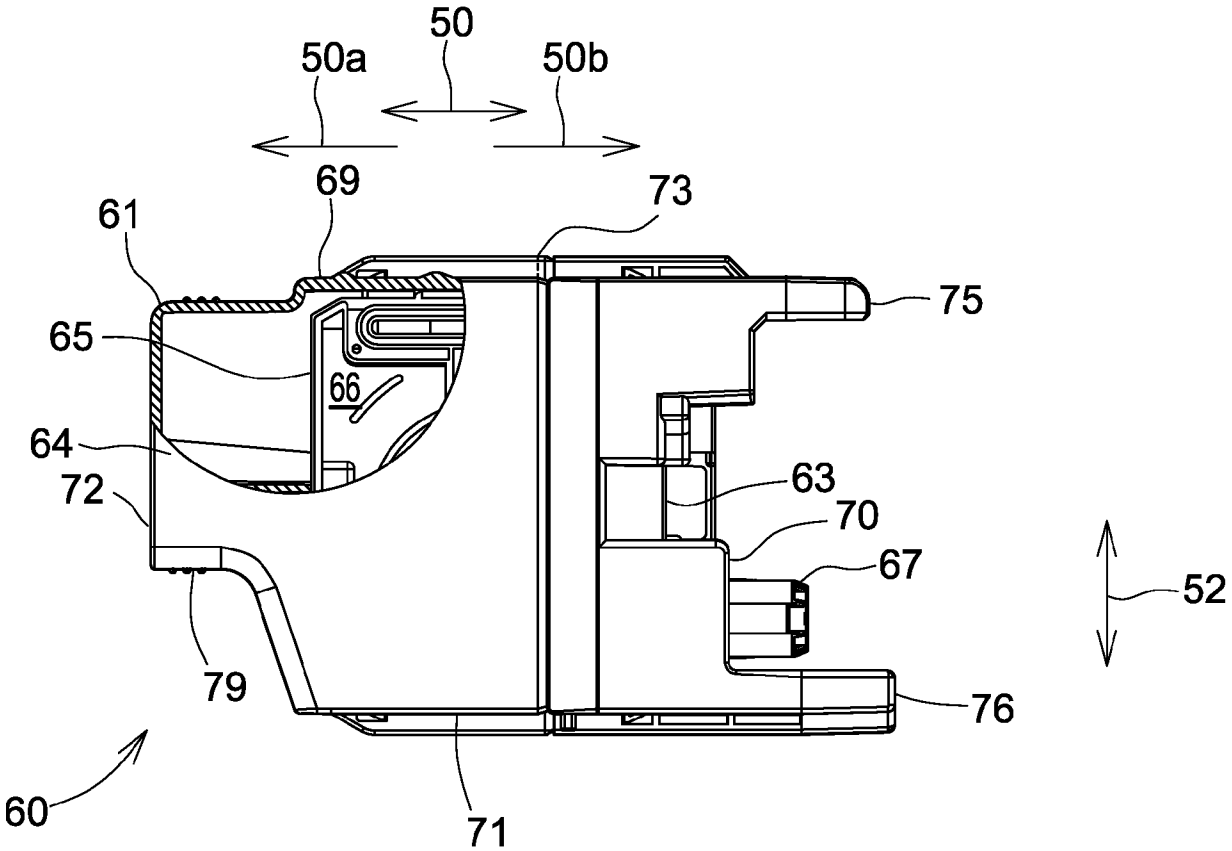
FIG. 7 is a partially cutaway side view of the second cartridge of FIG. 6.

Referring to FIGS. 5-7, second cartridge 60 may be a container configured to store ink therein. Second cartridge 60 selectively may be inserted into or removed from cartridge mounting portion 110 along insertion/removal path 50, e.g., insertion direction 50*b* or removal direction 50*a*, respectively.

Second cartridge 60 may comprise a main body 61 having a substantially rectangular parallelepiped shape. Main body 61 may have a flat, box shape having a width in width direction 51, a height in height direction 52, and a depth in depth direction 53, in which the width may be less than each of the height and the depth. Width direction 51, height direction 52, and depth direction 53 are perpendicular to each other. When second cartridge 60 selectively is inserted into and removed from cartridge mounting portion 110, insertion/removal path 50 is perpendicular to height direction 52 and parallel to depth direction 53. Main body 61 of second cartridge 60 may comprise a front wall 70 and a rear wall 72. Rear wall 72 may be disposed opposite front wall 70 along insertion/removal path 50. When second cartridge 60 is inserted into cartridge mounting portion 110, front wall 70 may face in insertion direction 50*b*, and rear wall 72 may face in removal direction 50*a*. Main body 61 of second cartridge 60 may comprise a top wall 69 and a bottom wall 71 opposite top wall 69 in height direction 52. A rear end of top wall 69 is connected to an upper end of rear wall 72, and a front end of top wall 69 is connected to an upper end of front wall 70. A front end of bottom wall 71 is connected to a lower end of front wall 70, but a rear end of bottom wall 71 is not connected directly to a lower end of rear wall 72. The rear end of bottom wall 71 is connected to the lower end of the rear wall 72 via a recessed corner portion 79. Top wall 69 or bottom wall 71, or both, may extend substantially parallel to insertion/removal path 50 of ink cartridge 60. Guiding means may be provided on top wall 69 or bottom walls 71 to guide a movement of second cartridge 60 during insertion into or removal from cartridge mounting portion 110. Second cartridge 60 selectively may be inserted into and removed from cartridge mounting portion 110 along insertion/removal path 50, in an orientation shown in FIG. 5, e.g., with top wall 69 facing opposite to bottom wall 71 in height direction 52.

Main body 61 may comprise an internal container 65 and a cover member 64 configured to cover internal container 65. Internal container 65 may comprise an ink chamber 66 formed therein. Cover member 64 may comprise front wall 70, rear wall 72, top wall 69, and bottom wall 71. As shown in FIG. 7, ink chamber 66 may be formed in an interior of internal container 65 and may be separated from rear wall 72 by a predetermined distance. Ink chamber 66 may have a length in depth direction 53 less than a length of ink chamber 36 of first cartridge 30. Ink chamber 66 may have an ink capacity less than an ink capacity of ink chamber 36 of first cartridge 30.

A residual amount detection portion 63 may be positioned substantially at a middle portion of front wall 70 of main body 61 in height direction 52. Residual amount detection portion 63 may have an open-box shape with an open end. Residual amount detection portion 63 may be configured to be in fluid communication with ink chamber 66 via the open end. Residual amount detection portion 63 may comprise a pair of walls comprising translucent, e.g., transparent or semi-transparent, resin configured to allow light, e.g., infrared or visible light, emitted from optical sensor 114 to pass therethrough. Optical sensor 114 may be positioned at cartridge mounting portion 110. When second cartridge 60 is mounted to cartridge mounting portion 110, residual amount detection portion 63 may allow the light emitted from optical sensor 114 to pass therethrough, or may block or attenuate the light, depending on an amount of ink stored in ink chamber 66. Based on an amount of light passing through residual amount detection portion 63, it may be determined whether the residual ink amount in ink chamber 66 may be determined to be less than a predetermined amount. Residual amount detection portion 63 may comprise a detection device, e.g., a light blocking plate, positioned in residual amount detection portion 63 and configured to move based on the amount of ink stored in ink chamber 66. Residual amount detection portion 63 may comprise a prism that diverts or bends light in different directions based on the amount of ink stored in ink chamber 66. The pair of walls irradiated with the light emitted from optical sensor 114 may be vertical, e.g., extending in height direction 52, or may be inclined with respect to the vertical direction, e.g., inclined with respect to height direction 52.

An air communication opening 62 may be positioned at front wall 70 above residual amount detection portion 63 in height direction 52. In particular, air communication opening 62 may be formed through front wall 70 in depth direction 53. Ink chamber 66 and the atmosphere outside the second cartridge 60 may be placed into fluid communication with each other via air communication opening 62. Air communication opening 62 may be configured to be opened and closed selectively by a valve (not shown). When air communication opening 62 is opened, pressure in ink chamber 66 may equalize to atmospheric pressure. In another embodiment, air communication opening 62 may be disposed at a different location within main body 61 and may be configured to bring the interior of ink chamber 66 into fluid communication with the exterior of ink chamber 66, e.g., the atmosphere. Further, in yet another embodiment, if the interior of ink chamber 66 is maintained at negative pressure, air communication opening 62 may be omitted.

A communication portion, e.g., an ink supply portion 67, may be disposed at front wall 70 below residual amount detection portion 63 in height direction 52. Ink supply portion 67 may have a cylindrical outer shape. Ink supply portion 67 may extend outward from and perpendicular to front wall 70. An ink flow path 68 may be formed in a middle portion of ink supply portion 67 to extend along insertion/removal path 50. Ink stored in ink chamber 66 may flow into ink supply tube 122 via ink flow path 68.

A rear portion of top wall 69 of main body 61 in insertion direction 50*b* may be lower, in height direction 52, than a front portion of top wall 69. The rear portion of top wall 69 may be disposed closer to rear wall 72 than to front wall 70, and the front portion of top wall 69 may be disposed closer to front wall 70 than to rear wall 72. A vertical wall 73 may be formed substantially at a middle portion of top wall 69 along insertion/removal path 50. Vertical wall 73 may comprise a plane extending in width direction 51 and height direction 52 of second cartridge 60. As shown FIGS. 1 and 8-13, lock lever 145 of cartridge mounting portion 110 may be configured to engage vertical wall 73 when second cartridge 60 is mounted to cartridge mounting portion 110. Vertical wall 73 may be configured to receive an urging force that urges second cartridge 60 out of cartridge mounting portion 110 in removal direction 50*a*.

Second cartridge 60 may comprise a first protrusion 75 and a second protrusion 76. First protrusion 75 may be disposed at the upper end of front wall 70 of main body 61. A width of first protrusion 75 may be equal to a width of front wall 70 in width direction 51. First protrusion 75 may be connected to or formed on front wall 70 and may extend outward from front wall 70. For example, first protrusion 75 may extend in insertion direction 50*b* away from front wall 70. In another embodiment, first protrusion 75 may have a plate shape having a width which is less than the width of front wall 70 in width direction 51.

Second protrusion 76 may be disposed at the lower end of front wall 70 of main body 61 below ink supply portion 67 in height direction 52. Second protrusion 76 may be positioned adjacent to bottom wall 71 of main body 61. A width of second protrusion 76 may be equal to a width of front wall 70. Second protrusion 76 may be connected to or formed on front wall 70 and may extend outward from front wall 70. Second protrusion 76 may extend in insertion direction 50*b* away from front wall 70. Second protrusion 76 may extend further from front wall 70 than ink supply portion 67 extends from front wall 70 in insertion direction 50*b*, e.g., an end of second protrusion 76 may be disposed further away from ink chamber 66 than an end of ink supply portion 67 is disposed away from ink chamber 66. Moreover, the end of second protrusion 76 may protrude further in insertion direction 50*b* than an end of first protrusion 75. In another embodiment, second protrusion 76 may have a plate shape having a width which is less than the width of front wall 70. Referring to FIG. 6, second protrusion 76 may extend from front wall 70 in insertion direction 50*b* by a length L2. Length L2 may be based on an ink capacity of second cartridge 60. The length of the second protrusion may vary from one cartridge to another based on the ink capacity of cartridge. For example, a cartridge having a different ink capacity than the ink capacity of second cartridge 60 may comprise a second protrusion having a different length than length L2. Length L2 may have a relationship with the initial amount of ink stored in ink chamber 66. The length of the second protrusion may vary from one cartridge to another based on the initial amount of ink stored in the cartridges. For example, a cartridge storing a different initial amount of ink than the initial amount of ink stored in second cartridge 60 may comprise a second protrusion having a different length than length L2.

Length L1 of first cartridge 30 may be different from length L2 of second cartridge 60 in insertion/removal path 50 based on the ink capacities of first cartridge 30 and second cartridge 60 and based on the initial amounts of ink stored in ink chambers 36 and 66. Length L2 may be longer than length L1. In another embodiment, length L1 of first cartridge 30 may be different from length L2 of second cartridge 60 in insertion/removal path 50 based on the colors of ink stored in ink chambers 36 and 66, e.g., based on coloring agents, a dye or a pigment, of ink stored in ink chambers 36 and 66, or based on the prices of ink cartridges 30 and 60, e.g., a higher price cartridge or a lower price cartridge.

Length L2 of second protrusion 76 may be based on an outer shape of the rear portion of main body 61. For example, length L2 of second protrusion 76 may be based on an outer shape of rear wall 72 and a portion of main body 61 adjacent to rear wall 72. The length of the second protrusion may vary from one cartridge to another based on the outer shape of the rear portion of a main body of cartridges. For example, a cartridge comprising a main body whose rear portion has a different outer shape than the outer shape of the rear portion of main body 61 may comprise a second protrusion having a different length than length L2. As shown in FIG. 6, main body 61 of second cartridge 60 may have a rectangular shape from which a corner portion thereof adjacent to rear wall 72 may be cut out, such that recessed corner portion 79 may be formed adjacent to rear wall 72. Rear wall 72 may have a length L4 in height direction 52. Length L4 may be based on an initial amount of ink stored in ink chamber 66. The length of the rear wall may vary from one cartridge to another based on the initial amount of ink stored in an ink chamber. For example, a cartridge storing a different initial amount of ink than the initial amount of ink stored in second cartridge 60 may comprise a rear wall having a different length than length L4. A height of front wall 70, e.g., a length L7 between top wall 69 and bottom wall 71, may be equal to length L7 between top wall 39 and bottom wall 41 of main body 31 of first cartridge 30. Length L4 may be shorter than length L3 of rear wall 42 of first cartridge 30. More specifically, length L4 may be shorter than length L7 between bottom wall 71 and top wall 69 of second cartridge 60 in height direction 52. Length L4 may be less than or equal to seventy-five percent of length L7 between bottom wall 71 and top wall 69. This range is found to yield suitable dimensions for holding portion 74, such that a user may hold, insert or remove the cartridge with ease.

Main body 61 may have a length L6 between front wall 70 and rear wall 72 along insertion/removal path 50. Length L6 may be independent of the cartridge and may not vary from one ink cartridge to another based on length L2 of second protrusion 76. For example, a cartridge comprising a second protrusion having a different length than length L2 may have the same length L6 between a front wall and a rear wall of a main body. Therefore, length L6 of second cartridge 60 may be equal to length L5 of first cartridge 30. The width of main body 61 of second cartridge 60 in width direction 51 may be equal to the width of main body 31 of first cartridge 30 in width direction 51.

Holding portion 74 may comprise a pair of side walls 77 and 78 each connected to upper wall 69 and recessed corner portion 79. Upper wall 69 may be connected to the upper end of rear wall 72. Recessed corner portion 79 may be connected to or formed within the lower end of rear wall 72. Holding portion 74 may be grasped by a user to remove second cartridge 60 from cartridge mounting portion 110. A length L9 extending from the rear end of bottom wall 71 to the end of second protrusion 76 in insertion direction 50*b* may be less than a total length, e.g., L2+L6, of second cartridge 60. The total length of second cartridge 60 may extend from an end of holding portion 74 to the end of second protrusion 76 in insertion direction 50*b*. Bottom wall 71 may provide a guiding means and a sliding surface, or both, for cartridge upon insertion and removal and holding portion 74 may allow the cartridge to reach further outside of cartridge mounting portion 110 than proximate to a rear end of the bottom wall 71 during insertion or removal of the cartridge. Therefore, the cartridge may be removed more easily by means of holding portion 74.

In another embodiment, cover member 64 and internal container 65 of main body 61 may be an integrally-formed or integrally-molded component. In yet another embodiment, main body 61 may comprise light-blocking resin. Main body 61 may be formed into a box-shape with an open end facing frontward in insertion direction 50*b*. Ink chamber 66 may be disposed in an interior of main body 61. A cover comprising a translucent, e.g., transparent or semi-transparent, resin may be attached to the open end. The cover may comprise a front wall, and a residual amount detection portion and an ink supply portion integrally formed at the front wall. A first protrusion and a second protrusion may be connected to or formed within the front wall.

Figure 8:
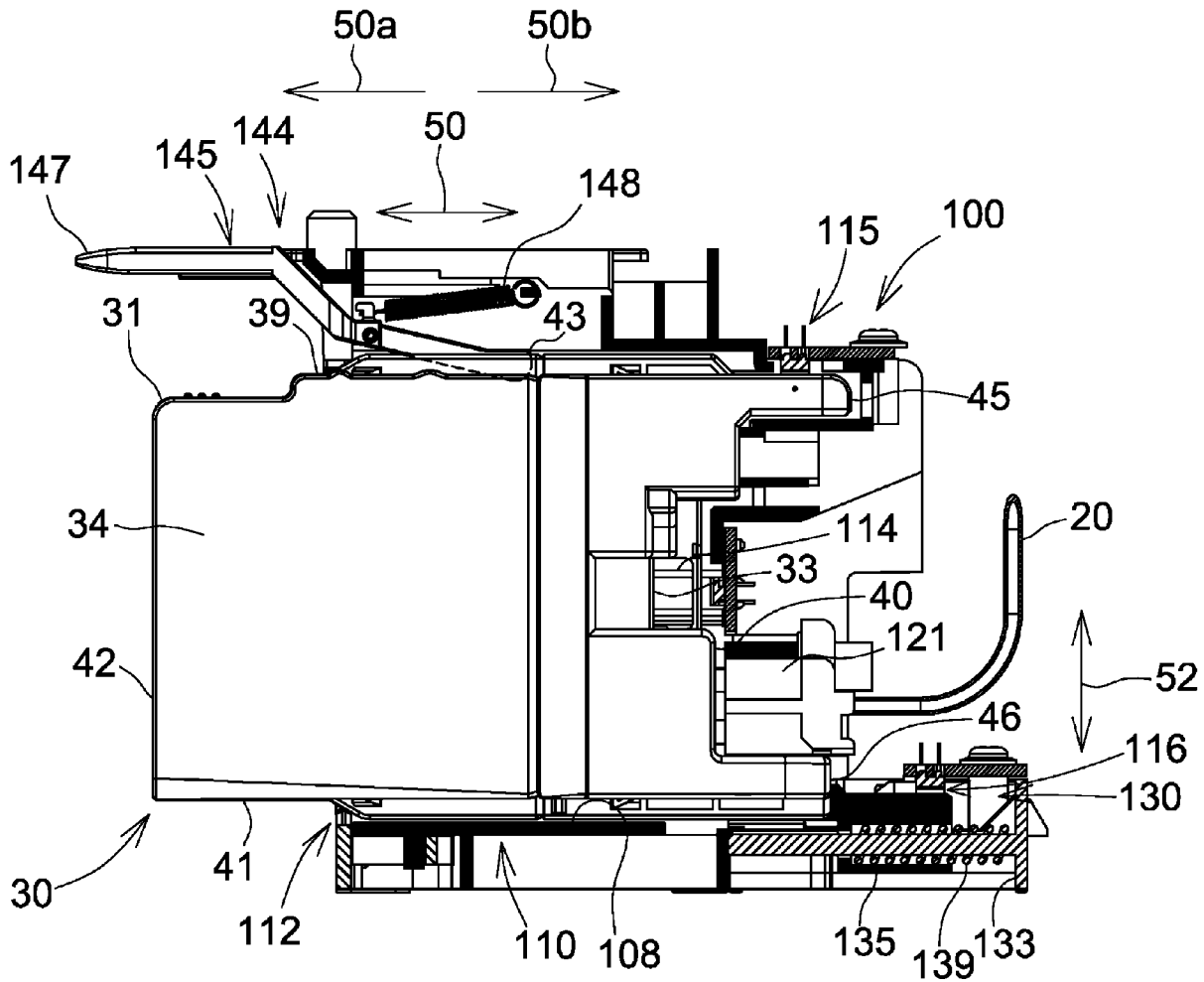
FIG. 8 is a side view of the first cartridge of FIG. 3 and a side cross-sectional view of a cartridge mounting portion, in which the first cartridge is mounted to the cartridge mounting portion.

Referring to FIGS. 1 and 8, cartridge mounting portion 110 may have opening 112 formed therethrough. First cartridge 30 and second cartridge 60 respectively may be configured to be mounted removably on cartridge mounting portion 110. Cartridge mounting portion 110 may comprise a horizontally-extending supporting surface 108, and cartridges 30 and 60, respectively, may be configured to slide on supporting surface 108 along insertion/removal path 50 when cartridges 30 and 60, respectively are inserted into and removed from cartridge mounting portion 110. Supporting surface 108 may be an inner bottom surface facing the inner space of cartridge mounting portion 110.

Cartridge mounting portion 110 may comprise optical sensor 114, a lock mechanism 144, a slide member 135, a coil spring 139, and a coupling portion 121. Optical sensor 114 may be disposed at an end of cartridge mounting portion 110 opposite opening 112, and optical sensor 114 may extend into an inner space of cartridge mounting portion 110. Optical sensor 114 may be configured to detect the detection device, e.g., a light blocking plate, disposed in residual amount detection portion 33 or 63 if residual amount detection portion 33 or 63 comprises the detection device. Optical sensor 114 may be a transmissive photo-interrupter comprising a light-emitting element, e.g., light-emitting diode, configured to emit light, e.g., visible light or infrared light, and a light-receiving element, e.g., a phototransistor, configured to receive the light emitted from the light-emitting element. The light-emitting element and the light-receiving element may be positioned with a distance therebetween in width direction 51. When cartridge 30 or 60 is mounted to cartridge mounting portion 110, residual amount detection portion 33 or 63 may be disposed between the light-emitting element and the light-receiving element. Depending on the amount of ink stored in cartridge 30 or 60, the detection device may block the light emitted from the light-emitting element, such that the light does not reach the light receiving element, or the detection device may not block the light, such that the light receiving element receives the light. It may be determined whether the amount ink stored in cartridge 30 or 60 is less than the predetermined amount, based on an amount of light received by optical sensor 114.

In another embodiment, instead of the detection device blocking the light, the light emitted from the light-emitting element may be attenuated or deviated when there is ink in residual amount detection portion 33 or 63, and may pass through residual amount detection portion 33 or 63 when there is no ink in residual amount detection portion 33 or 63. Alternatively, the light emitted from the light-emitting element may be reflected on or in the ink in residual amount detection portion 33 or 63 so as not to reach the light-receiving element when there is ink in residual amount detection portion 33 or 63, and the light may be reflected on or in the residual amount detection portion 33 or 63 so as to be received by the light-receiving element when there is no ink in residual amount detection portion 33 or 63.

A slide member 135 may be disposed in a space 130 formed at a lower portion of the end of cartridge mounting portion 110 opposite opening 112 in height direction 52. Space 130 may be continuous with the inner space of cartridge mounting portion 110 via one end of space 130 along insertion/removal path 50 and the other end of space 130 may be bounded by a back wall 133. Slide member 135 may be slidably supported in space 130, such that slide member 135 may slide along insertion/removal path 50. Slide member 135 may be disposed so as to selectively contact second protrusion 46 of first cartridge 30 and second protrusion 76 of second cartridge 60 when cartridge 30 or 60 is mounted to cartridge mounting portion 110, respectively.

As shown in FIGS. 8-13, further optical sensors 115 and 116 may be disposed in cartridge mounting portion 110. Optical sensors 115 and 116 may have substantially the same optical properties as optical sensor 114. When first or second cartridge 30, 60 is inserted into cartridge mounting portion 110, the corresponding first protrusion 45 or 75, respectively, may block or interrupt an optical path of optical sensor 115 which is indicative of the presence of ink cartridge 30 or 60 inside the recording apparatus. Thus, first protrusion 45 or 75 may form a light blocking portion. Similarly, second protrusions 46 or 76 may contact spring-biased slide member 135, which may block or interrupt an optical path of optical sensor 116 depending on length L1 or L2 of the second protrusion. Because length L1 or L2 may be associated with an initial amount of ink in the cartridge or with an ink capacity of the cartridge, second protrusion 46 or 76 may be indicative of the initial ink amount or ink capacity.

Figure 10:
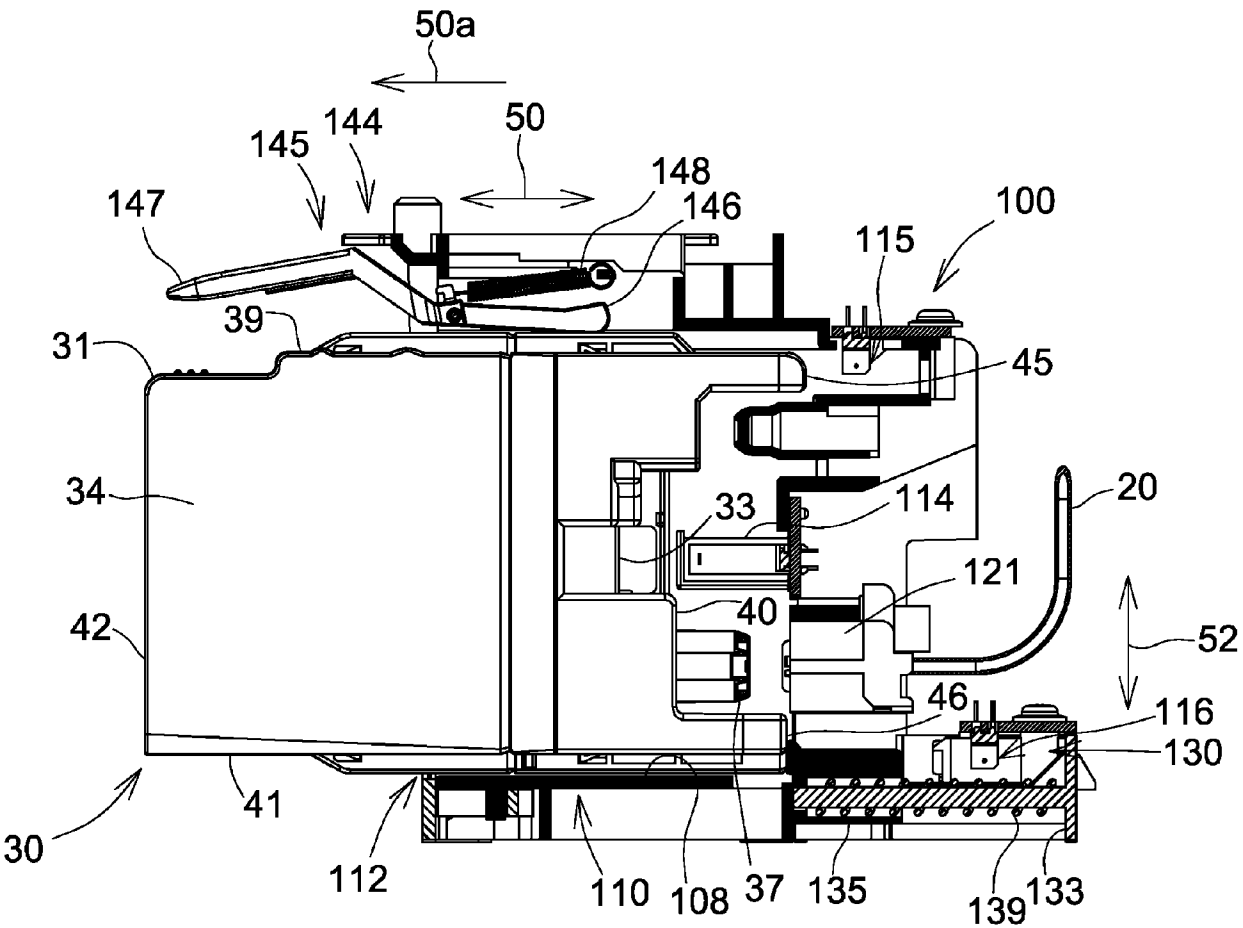
FIG. 10 is a side view of the first cartridge of FIG. 3 and a side cross-sectional view of the cartridge mounting portion of FIG. 8, in which the first cartridge is being removed from the cartridge mounting portion.

Coil spring 139 may be disposed in space 130. Coil spring 139 may urge slide member 135 elastically toward opening 112, e.g., in removal direction 50*a*. One end of coil spring 139 may be connected to back wall 133. The other end of coil spring 139 may be connected to slide member 135. As shown in FIG. 10, when coil spring 139 is at its natural length, e.g., when no external force is applied to coil spring 139 via slide member 135, slide member 135 may be disposed closer to opening 122. Second protrusion 46 or 76 may contact and push slide member 135 toward back wall 133 during the insertion of cartridge 30 or 60 into cartridge mounting portion 110. As shown in FIG. 8, coil spring 139 may be compressed, and slide member 135 may slide toward back wall 133. The distance by which slide member 135 is moved toward back wall 133, may depend on length L1 or L2 of second protrusion 46 or 76, respectively.

Lock mechanism 144 may be disposed at an upper portion of cartridge mounting portion 110. When cartridge 30 or 60 is mounted to cartridge mounting portion 110, lock mechanism 144 may be configured to retain cartridge 30 or 60 in a mounted position in cartridge mounting portion 110 by restricting the movement of cartridge 30 or 60 in removal direction 50*a*, e.g., a leftward direction in FIGS. 8-13.

Figure 11:
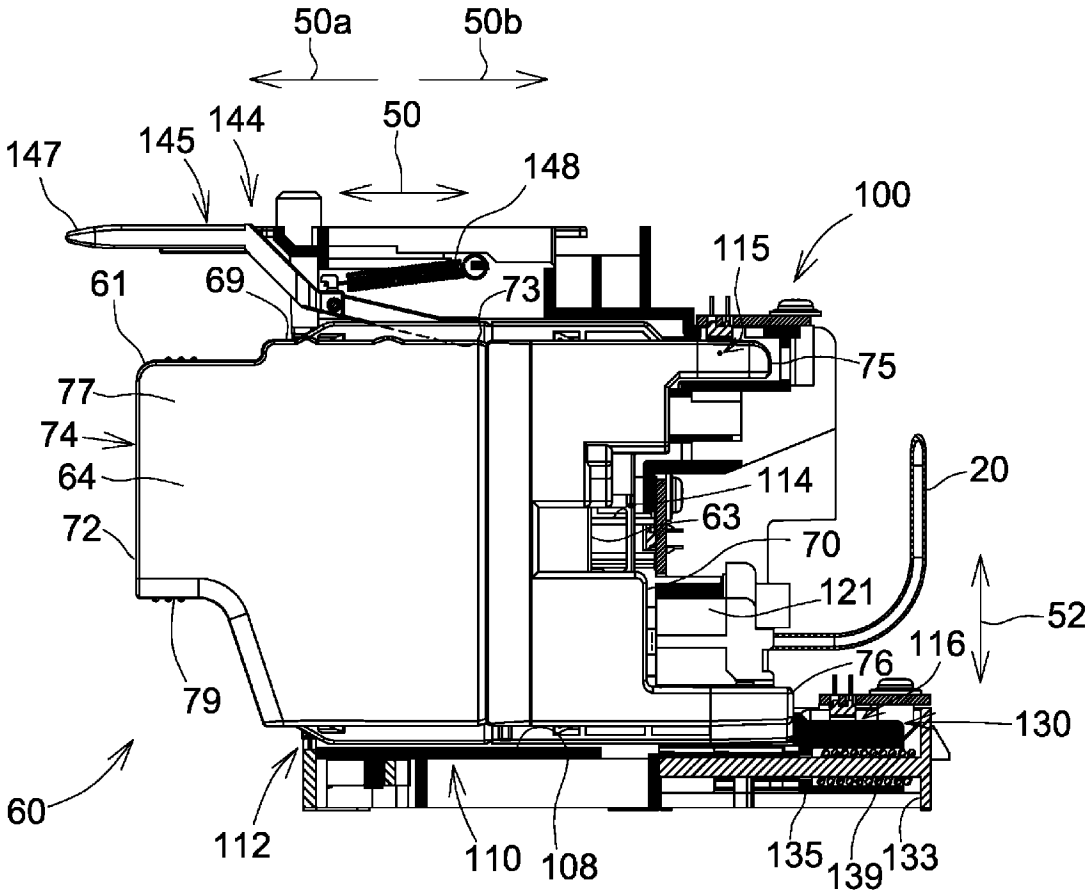
FIG. 11 is a side view of the second cartridge of FIG. 6 and a side cross-sectional view of the cartridge mounting portion of FIG. 8, in which the second cartridge is mounted to the cartridge mounting portion.

Lock mechanism 144 may comprise lock lever 145 and a coil spring 148 configured to apply an urging force to lock lever 145. Lock lever 145 may be supported pivotally, such that lock lever 145 may pivot between an unlock position, as shown in FIGS. 9, 10, 12 and 13, and a lock position, as shown in FIGS. 8 and 11. In the absence of an external force applied to lock lever 145, coil spring 148 may bias lock lever 145 toward the lock position. An end of lock lever 145 may comprise an engagement end 146. Lock lever 145 may lock or retain cartridge 30 or 60 in the mounted position in cartridge mounting portion 110 when engagement end 146 engages vertical wall 43, 73 of cartridge 30 or 60.

A coupling portion 121 may be disposed at the end of cartridge mounting portion 110 opposite opening 112. Coupling portion 121 may extend into the inner space of cartridge mounting portion 110. As shown in FIG. 1, coupling portion 121 may comprise ink supply tube 122. Ink supply tube 122 may extend along insertion/removal path 50. Ink supply tube 122 may be connected to flexible tube 20. When cartridge 30 or 60 is mounted to cartridge mounting portion 110, ink supply tube 122 may be inserted into ink flow path 38 or 68 of ink supply portion 37 or 67, respectively. Thus, coupling portion 121 may be connected to ink supply portion 37 or 67.

Ink stored in ink chamber 36 or 66 may be supplied to flexible tube 20 via ink supply tube 122.

Referring to FIG. 8, when first cartridge 30 is inserted into cartridge mounting portion 110, slide member 135 may slide toward back wall 133 while being pushed by second protrusion 46. While slide member 135 slides, coil spring 139 may contract from its natural length. When coil spring 139 contracts, slide member 135 may receive an urging force directed toward opening 112 from coil spring 139. Thus, first cartridge 30 mounted in cartridge mounting portion 110 may be urged elastically toward opening 112.

When vertical wall 43 of first cartridge 30 moves beyond engagement end 146 of lock lever 145 toward the end of cartridge mounting portion 110 opposite 112 during the insertion of first cartridge 30 into cartridge mounting portion 110, lock lever 145 may pivot, such that engagement end 146 moves to a position in which engagement end 146 may engage vertical wall 43. First cartridge 30 may be urged elastically by coil spring 139 via slide member 135 toward opening 112. Nevertheless, as shown in FIG. 8, because engagement end 146 engages vertical wall 43, first cartridge 30 may be retained in the mounted position in cartridge mounting portion 110. When first cartridge 30 is retained in the mounted position in cartridge mounting portion 110, ink supply tube 122 of coupling portion 121 may be inserted into ink flow path 38 of first cartridge 30, such that ink stored in ink chamber 36 may be supplied to the exterior of first cartridge 30.

Figure 9:
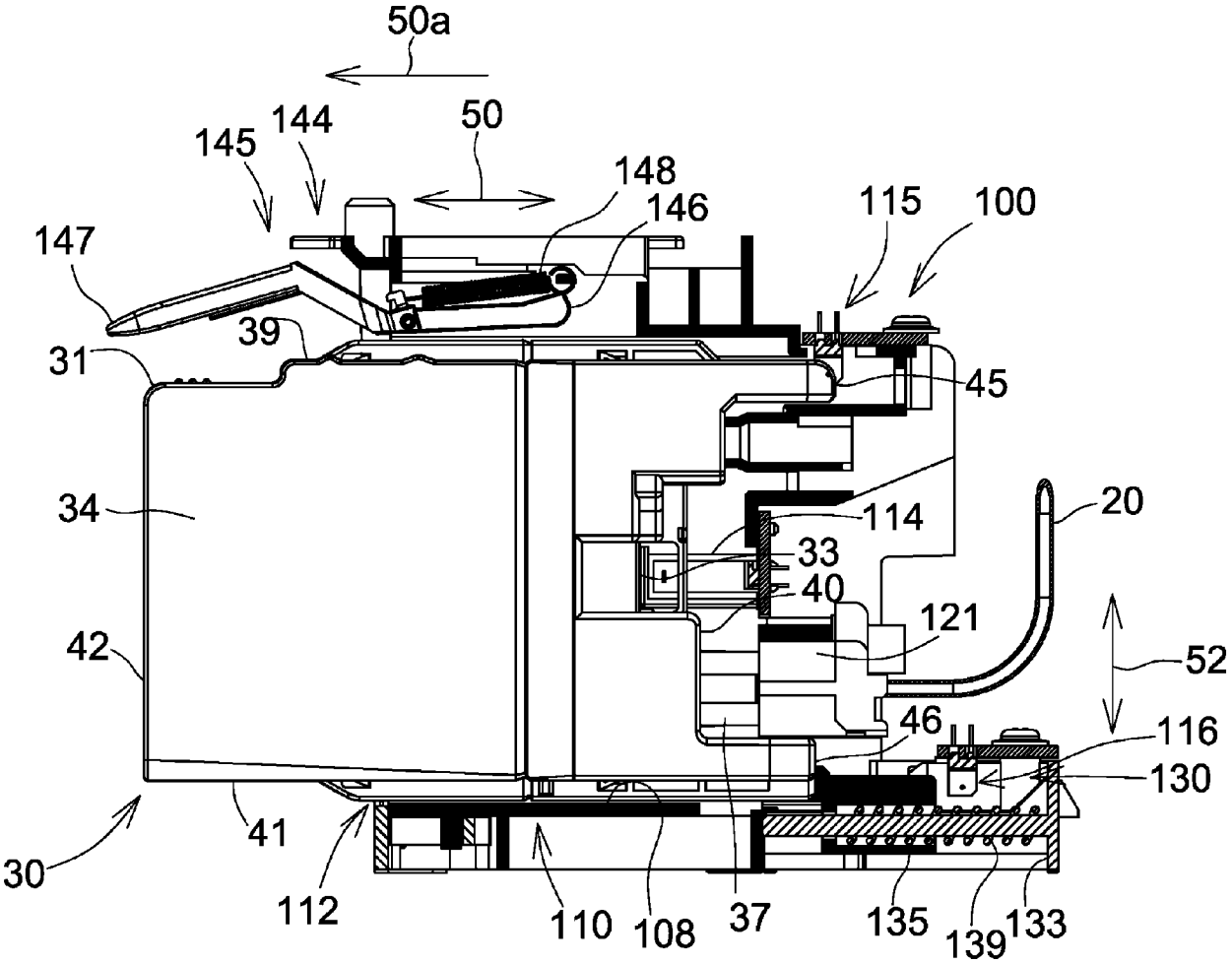
FIG. 9 is a side view of the first cartridge of FIG. 3 and a side cross-sectional view of the cartridge mounting portion of FIG. 8, in which the first cartridge is being removed from the cartridge mounting portion.

Referring to FIG. 9, when first cartridge 30 is removed from cartridge mounting portion 110, an operating portion 147 of lock lever 145 opposite engagement end 146 may be depressed. As shown in FIG. 9, depressing operating portion 147 may cause lock lever 145 to pivot counterclockwise to move from the lock position to the unlock position. When lock lever 145 is in the unlock position, engagement end 146 may separate from vertical wall 43 and be positioned above vertical wall 43. Coil spring 139 then may expand, and first cartridge 30 may be moved toward opening 122 in removal direction 50*a* by the elastic urging force of coil spring 139 via slide member 135. Ink supply tube 122 of coupling portion 121 may be removed from ink flow path 38 of first cartridge 30.

Referring to FIG. 10, when coil spring 139 further expands and is returned to its natural length, first cartridge 30 may not receive the elastic urging force of coil spring 139 and may stop moving due to the friction between first cartridge 30 and supporting surface 108. When coil spring 139 stops expanding, the rear portion of main body 31 of first cartridge 30 may come out of cartridge mounting portion 110 via opening 112 and may be disposed outside cartridge mounting portion 110. The length of the portion of main body 31 disposed outside cartridge mounting portion 110 along insertion/removal path 50, e.g., the distance between the rear wall 42 and the opening 112, may depend on length L1 of second protrusion 46 and length L5 of main body 31.

Referring to FIG. 11, when second cartridge 60 is inserted into cartridge mounting portion 110, slide member 135 may slide toward back wall 133 while being urged by second protrusion 76. While slide member 135 slides, coil spring 139 may contract from its natural length. When coil spring 139 contracts, slide member 135 may receive an urging force directed toward opening 112 from coil spring 139. Thus, second cartridge 60 mounted in cartridge mounting portion 110 may be urged elastically toward opening 112.

When vertical wall 73 of second cartridge 60 moves beyond engagement end 146 of lock lever 145 toward the end of cartridge mounting portion 110 opposite 112 during the insertion of second cartridge 60 into cartridge mounting portion 110, lock lever 145 may pivot, such that engagement end 146 moves to a position in which engagement end 146 may engage vertical wall 73. Second cartridge 60 may be urged elastically by coil spring 139 via slide member 135 toward opening 112. As shown in FIG. 11, engagement end 146 may engage vertical wall 73, and second cartridge 60 may be retained in the mounted position in cartridge mounting portion 110. When second cartridge 60 is retained in the mounted position in cartridge mounting portion 110, ink supply tube 122 of coupling portion 121 may be inserted into ink flow path 68 of second cartridge 60, such that ink stored in ink chamber 66 may be supplied to the exterior of second cartridge 60.

Figure 12:
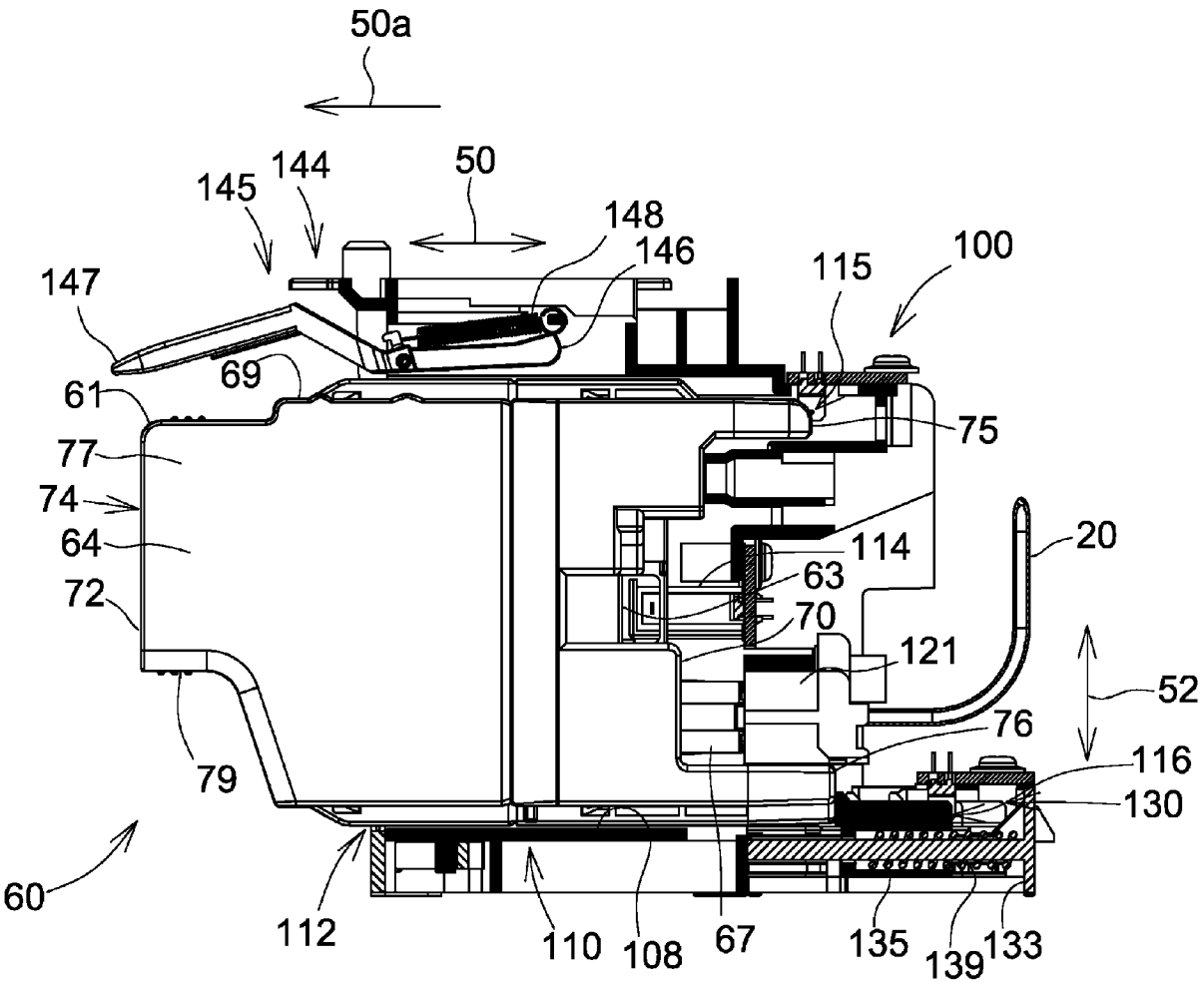
FIG. 12 is a side view of the second cartridge of FIG. 6 and a side cross-sectional view of the cartridge mounting portion of FIG. 8, in which the second cartridge is being removed from the cartridge mounting portion.
Figure 13:
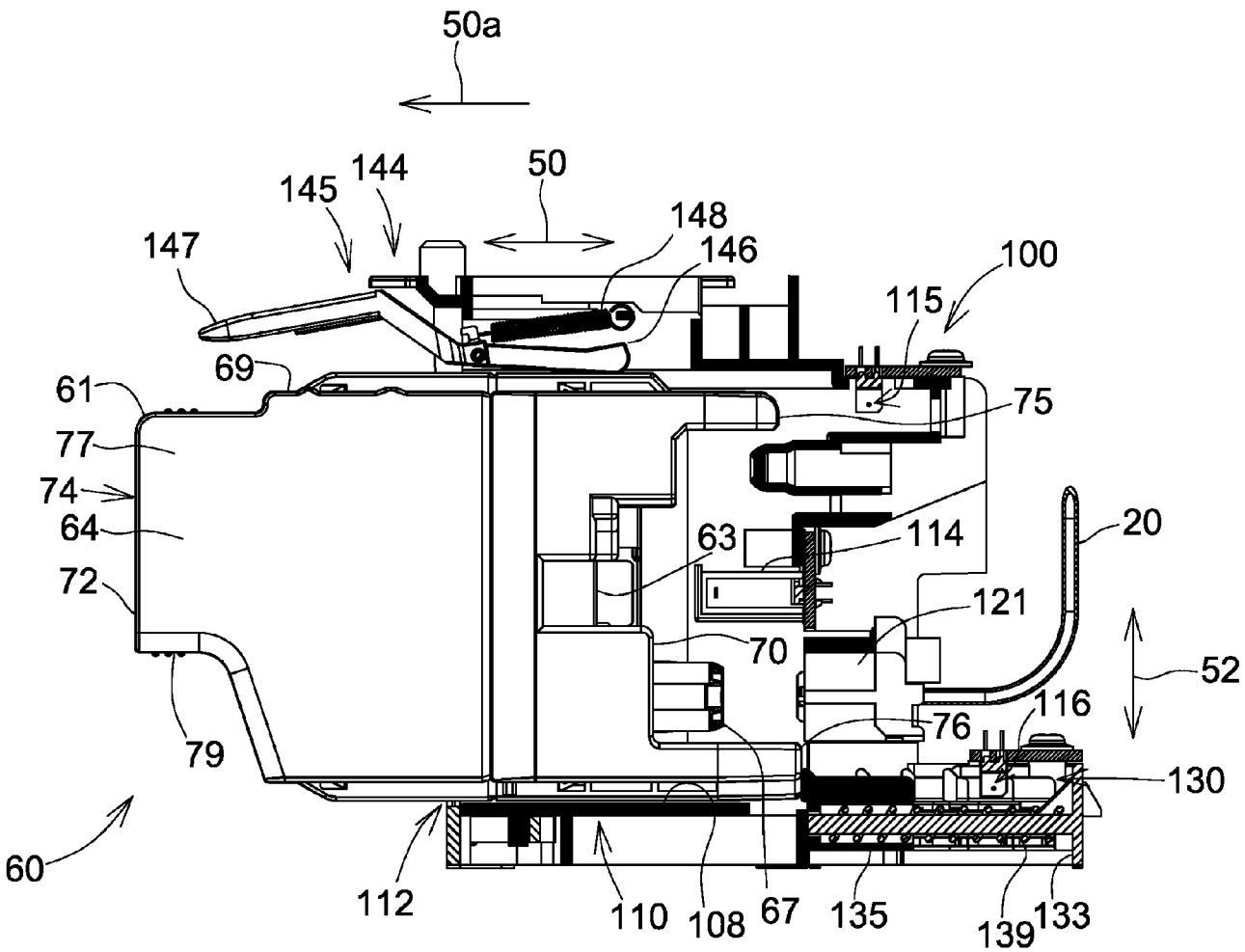
FIG. 13 is a side view of the second cartridge of FIG. 6 and a side cross-sectional view of the cartridge mounting portion of FIG. 8, in which the second cartridge is being removed from the cartridge mounting portion.

Referring to FIG. 12, when second cartridge 60 is to be removed from cartridge mounting portion 110, operating portion 147 of lock lever 145 may be depressed. As shown in FIG. 12, depressing on operating portion 147 may cause lock lever 145 to pivot counterclockwise to move from the lock position to the unlock position. When lock lever 145 is in the unlock position, engagement end 146 may separate from vertical wall 73 and be positioned above vertical wall 73. Coil spring 139 then may expand, and second cartridge 60 may be moved toward opening 122 in removal direction 50*a* by the elastic urging force of coil spring 139 via slide member 135. Ink supply tube 122 of coupling portion 121 may be removed from ink flow path 68 of second cartridge 60. Referring to FIG. 13, when coil spring 139 further expands and is returned to its natural length, second cartridge 60 does not receive the elastic urging force of coil spring 139 and stops moving by the friction between second cartridge 60 and supporting surface 108. When coil spring 139 stops expanding, the rear portion of main body 61 may have come out of cartridge mounting portion 110 via opening 112 and be disposed outside cartridge mounting portion 110. The length of the portion of main body 61 disposed outside cartridge mounting portion 110 along insertion/removal path 50, e.g., the distance between the rear wall 72, and the opening 112 may depend on length L2 of second protrusion 76 and length L6 of main body 61. Length L6 of main body 61 may be equal to length L5 of main body 31. Nevertheless, length L2 of second protrusion 76 may be longer than length L1 of second protrusion 46. Therefore, the length of the portion of main body 61 disposed outside cartridge mounting portion 110 may be longer than the length of the portion of main body 31 positioned outside cartridge mounting portion 110 by the difference between lengths L2 and L1.

Various types of cartridges, e.g., with various ink capacities and initial amounts of ink stored in the cartridges, may be readily distinguished by their appearances due to differences of lengths of second protrusion along insertion/removal path 50, even through the shapes or sizes of main bodies are substantially the same or similar.

More specifically, the various types of cartridges may be distinguished by a comparison of the length of a first difference between the sum of lengths L1 and L5 on the one side and a total length, i.e., sum of L1 and L5, of first cartridge 30 on the other side when measured along insertion direction 50*b*, with a second difference between the length L9 on the one side and the total length i.e., L2+L6 of second cartridge 60 on the other side. A comparison of these lengths may readily be accomplished since these lengths are clearly visible to a user viewing the installed cartridges from outside cartridge mounting portion 110 allowing the user to distinguish between cartridges 30 and 60. Thereby, the sum of lengths L1 and L5 or the sum of lengths L2 and L6 may be a distance extending from a rear end of bottom wall 41 of first cartridge 30 to an end of protrusion 46 of first cartridge 30, i.e., tip of protrusion extending most forward in insertion direction 50*b*, in insertion direction 50*b*, or a distance extending from a rear end of bottom wall 71 of second cartridge 60 to a corresponding end of protrusion 76 of second cartridge 60 in insertion direction 50*b*. The end of the protrusion may be a portion which contacts sliding member 135. Cartridges may be distinguished from each other by comparing a length difference between a length of a bottom section of the cartridge with a total length of the cartridge. For example, first cartridge 30 has a length difference of zero, and second cartridge 60 has a length difference greater than zero.

By changing the dimension of the corner portions at the rear portion of the ink cartridges, ink capacities of ink chambers 36 and 66 may be changed without changing the widths of cartridges 30 and 60 in width direction 51. Therefore, a printer for business use may not require a cartridge having a wide dimension in width direction 51, and, therefore, cartridge mounting portion 110 may not have a significant, non-utilized space in width direction 51. Accordingly, the physical size of printer 10 may be reduced.

With this configuration, reduction of physical size of the recording apparatus in a width direction may not be prevented, because the capacity of the ink cartridge may be changed by the first difference between the lengths of the first cartridge along the insertion direction and the second difference between the lengths of the second cartridge along the insertion direction. Moreover or alternatively, an appearance of the ink cartridge, i.e., the first difference between the lengths of the first cartridge along the insertion direction and the second difference between the lengths of the second cartridge along the insertion direction, may indicate a type of the ink cartridge, e.g., may indicate an ink capacity of the ink cartridge. Thus, a user easily may recognize which cartridge is mounted in the cartridge mounting portion simply by viewing the cartridge in the insertion direction from the outside of cartridge mounting portion, without removing the cartridge from the cartridge mounting portion.

While length L5 between front wall 40 and rear wall 42 of main body 31 and length L6 between front wall 70 and rear wall 72 of main body 61 may be equal, lengths L1 and L2 of second protrusions 46 and 76 may be different. Therefore, when cartridges 30 and 60 are removed from cartridge mounting portion 110, and when cartridges 30 and 60 are moved toward opening 112, the positions at which cartridges 30 and 60 stop moving along insertion/removal path 50 may differ due to the differences between length L1 and length L2 of second protrusion 46 and 76, respectively. As shown in FIGS. 10 and 13, second cartridge 60 with second protrusion 76 having the greater length L2 stops at a position further outside off cartridge mounting portion 110 than first cartridge 30 because second protrusion 76 is longer with regard to second cartridge 60 and because urging member 139 is more biased when second cartridge 60 is inserted in cartridge mounting portion 110. Consequently, removal of second cartridge 60 may be facilitated by a combination of the holding portion 74, as described above, and the greater length of second protrusion 76.

Due to the greater length L2 of second protrusion 76 of second cartridge 60, as compared with length L1 of second protrusion 46 of first cartridge 30, second protrusion 76 may protrude further in insertion direction 50*b*, when cartridges 30 and 60 are mounted in cartridge mounting portion 110, respectively. Consequently, urging member 139 may be more biased when second cartridge 60 is inserted than when first cartridge 30 is inserted. Therefore, first cartridge 30 also may be ejected similar to second cartridge 60, but may stop at a position closer to urging member 139 in removal direction 50*a* than second carriage 60 does when second cartridge 60 is ejected by urging member 139. Further, when cartridges 30 and 60 are in a state of completed installation within cartridge mounting portion 110 of recording apparatus 10, sliding member 135 may be pushed further in insertion direction 50*b* in case of second cartridge 60 than in the case of first cartridge 30. Second protrusion 76 of second cartridge 60 protrudes further in insertion direction 50*b* and thus further into recording apparatus 10, e.g., beyond an end face of the cartridge mounting portion 110. Sliding member 135 may serve as a light blocking portion indicative of a property of the ink cartridge 30 or 60, e.g., ink capacity or initial ink amount stored within the ink chamber 36 or 66.

Thus, the different lengths L1 and L2, or the comparatively greater distance by which second protrusion 76 of second cartridge 60 extends into cartridge mounting portion 110 along insertion direction 50*b* may allow the characteristic, e.g., ink capacity, of a cartridge, e.g., first cartridge 30, to be readily distinguished from another cartridge, e.g., second cartridge 60, by sensors 116 and associated integrated circuits (not shown) of the recording apparatus. In addition, when first cartridge 30 and second cartridge 60 are mounted in cartridge mounting portions 110 adjacent to each other in width direction 51, instead of in place of each other, holding portion 74 of second cartridge 60 may be grasped by a user to readily remove second cartridge 60. This may become particularly advantageous, when multiple cartridges are to be replaced one after the other, and the second cartridge is removed first.

Lengths L1 and L2 of second protrusions 46 and 76, respectively, may be based on the outer shapes of rear portions of main bodies 31 and 61. Therefore, even when second protrusion 46 or 76 is not able to be seen when first cartridge 30 or second cartridge 60 is mounted to cartridge mounting portion 110, whether a cartridge is first cartridge 30 or second cartridge 60 may be identified by the outer shape of the rear portion of main body 31 or 61, respectively, when a user examines first cartridge 30 or second cartridge 60 from the outside of cartridge mounting portion 110 in insertion direction 50*b*.

Shapes of outer surfaces of top walls 39 and 69 may be substantially the same between cartridges 30 and 60 regardless of the length of second protrusions 46, 76. Therefore, vertical walls 43 and 73 may be disposed at substantially same position at top walls 39 and 69, respectively, between cartridges 30, 60.

Length L3 may be substantially equal to length L7. Further, top wall 39 and bottom wall 41 may be substantially perpendicular to front wall 40 and rear wall 42. Therefore, main body 31 may have a substantially rectangular parallelepiped shape, and the ink capacity of ink chamber 36 of first cartridge 30 may be readily increased.

In the above-described embodiment, length L1 of second protrusion 46 of first cartridge 30 and length L2 of second protrusion 76 of second cartridge 60 may be different. Similarly, in another embodiment, first protrusion 45 of first cartridge 30 and first protrusion 75 of second cartridge 60 may be structured to have different lengths. In this case, slide member 135 and coil spring 139 may be positioned at an upper portion of cartridge mounting portion 110 so as to contact first protrusions 45, 75.

In the above-described embodiment, holding portion 74 is formed via a recessed corner portion 79 which extends between the bottom wall 71 and the rear wall 72. Recessed corner portion 79 results in a reduced vertical dimension, i.e., length L4, of the rear portion of the cartridge, thereby forming holding portion 74, by which the cartridge may be gripped at holding portion 74. In an alternative embodiment, main body 61 may not comprise recessed corner portion 79, but instead may comprise a resilient, elastic or deformable member extending from rear wall 72 or from one or both of the pair of side walls 77, 78 adjacent to rear wall 72 in removal direction 50*a*, e.g., in the rearward direction, which may allow the cartridge to be withdrawn from cartridge mounting portion 110. More specifically, in this alternative embodiment, the rear wall 72 may extend directly from the rear end of the bottom wall 71 up to the rear end of the top wall 69, and the resilient, elastic or deformable member, e.g., a spring or a bellows-like member may extend from the rear wall 72 or from one or both of the pair of side walls 77, 78 adjacent to the rear wall 72 in removal direction 50*a*. Even without the recessed corner portion 79, the total length of the cartridge measured along insertion/removal path 50, i.e., the length extending from the rear end of the resilient, elastic, or deformable member to the front end of protrusion 76 and in insertion direction 50*b*, may be greater than length L9, i.e., the length extending from the rear end of bottom wall 71 to the front end of protrusion 76 in insertion direction 50*b*, whereby space may be saved.

In another alternative embodiment, main body 61 may not comprise recessed corner portion 79, but instead may comprise a pivot member which extends from the corner between rear wall 72 and top wall 69 in removal direction 50*a*, i.e., in the rearward direction, and is configured to pivot about the corner between rear wall 72 and top wall 69. More specifically, in this alternative embodiment, rear wall 72 may extends directly from the rear end of the bottom wall 71 up to the rear end of top wall 69, and the pivot member may be configured to pivot about the corner between rear wall 72 and top wall 69. Even without the recessed corner portion 79, the total length of the cartridge measured along insertion/removal path 50, i.e., the length extending from the rear end of the pivot member to the front end of the protrusion 76 in insertion direction 50*b*, may be greater than length L9, i.e., the length extending from the rear end of the bottom wall 71 to the front end of the protrusion 76 in insertion direction 50*b*.

While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An ink cartridge configured to be removably mounted to a recording apparatus comprising an urging member configured to urge the ink cartridge in a removal direction, the ink cartridge comprising:

a main body comprising:

an ink chamber formed in an interior of the main body and configured to store ink therein, a particular wall having a first end and a second end opposite the first end in a further direction, wherein the further direction is perpendicular to the removal direction;

a communication portion positioned at the particular wall and configured to selectively place an interior of the ink chamber and an exterior of the ink chamber into fluid communication;

a holding portion positioned opposite the particular wall in an insertion direction, wherein the ink chamber is positioned between the particular wall and the holding portion, and the insertion direction is parallel to and opposite the removal direction; and a bottom wall;

a first protrusion extending from the main body in the insertion direction and away from the holding portion; and a second protrusion positioned adjacent to the bottom wall and extending from the main body in the insertion direction and away from the holding portion, wherein a particular end of the second protrusion extends further than a particular end of the first protrusion in the insertion direction, wherein a distance from a rear end of the bottom wall to the particular end of the second protrusion in the insertion direction is less than a distance from a rear end of the holding portion to the particular end of the second protrusion in the insertion direction, and wherein the communication portion is positioned between the first protrusion and the second protrusion in the further direction.

2. The ink cartridge of claim 1, wherein the main body comprises a recessed corner portion, and the holding portion comprises a further wall of the main body, wherein the further wall is opposite the particular wall in the insertion direction, and the rear end of the bottom wall is connected to the further wall via the recessed corner portion.

3. The ink cartridge of claim 2, wherein the main body further comprises a top wall opposite the bottom wall, and a distance between an upper end of the further wall and the lower end of the further wall in the further direction is less than a distance between the bottom wall and the top wall in the further direction.

4. The ink cartridge of claim 3, wherein the distance between an upper end of the further wall and the lower end of the further wall in the further direction is less than or equal to seventy-five percent of the distance between the bottom wall and the top wall in the further direction.

5. The ink cartridge of claim 2, wherein the recessed corner portion is recessed inward from the main body in substantially the insertion direction at a lower end of the further wall.

6. The ink cartridge of claim 2, wherein the further wall is a rear wall of the main body and the particular wall is a front wall of the main body.

7. The ink cartridge of claim 2, wherein the main body further comprises: a top wall; and a receiving portion positioned at an outer face of the top wall and connecting the first end of the particular wall and an upper end of the further wall, wherein the receiving portion configured to receive an urging force of the urging member.

8. The ink cartridge of claim 1, wherein at least one of the first protrusion and the second protrusion are connected to the particular wall and extend from the particular wall.

9. The ink cartridge of claim 1, wherein the holding portion is provided for holding and grasping the ink cartridge.

10. The ink cartridge of claim 1, wherein the holding portion is configured to receive a force for selectively inserting the ink cartridge into and removing the ink cartridge from the recording apparatus.

11. The ink cartridge of claim 1, wherein the second protrusion is positioned closer to the second end of the particular wall than to the first end of the particular wall, and the first protrusion is positioned closer to the first end of the particular wall than to the second end of the particular wall.

12. The ink cartridge of claim 1, wherein the first protrusion comprises a light blocking portion.

* * * * *